United States Patent [19]

O'Hanlon

[11] 4,320,604

[45] Mar. 23, 1982

[54] HEAVILY INSULATED SHELTER STRUCTURE

[76] Inventor: Edward J. O'Hanlon, Warren County, Assembly Point, Lake George, N.Y. 12845

[21] Appl. No.: 107,197

[22] Filed: Dec. 26, 1979

Related U.S. Application Data

[63] Continuation of Ser. No. 971,597, Dec. 20, 1978, abandoned.

[51] Int. Cl.[3] ..... E04B 7/04; E04B 1/80

[52] U.S. Cl. ..... 52/92; 52/93; 52/169.11; 52/236.6; 52/204

[58] Field of Search ..... 52/92, 93, 169.11, 169.6, 52/94, 236.6

[56] References Cited

U.S. PATENT DOCUMENTS

| | | | |
|---|---|---|---|
| 760,135 | 5/1904 | Miller | 52/92 |
| 2,339,220 | 1/1944 | Crowley | 52/236.6 X |
| 3,206,903 | 9/1965 | Johnson | 52/92 |
| 3,298,146 | 1/1967 | Retz | 52/169.6 |
| 3,462,897 | 8/1969 | Weinrott | 52/169.1 |
| 3,500,597 | 3/1970 | McKenzie | 52/94 |
| 3,513,828 | 5/1970 | Masters | 126/271 |
| 3,543,456 | 12/1970 | Gregoire | 52/92 |
| 3,665,662 | 5/1972 | Timbrook et al. | 52/92 X |
| 3,845,592 | 11/1974 | Patena | 52/93 |
| 3,854,260 | 12/1974 | O'Hanlon | 52/309.5 |

OTHER PUBLICATIONS

Architectural Record, Jul. 1950 pp. 134–139.

*Primary Examiner*—Alfred C. Perham
*Attorney, Agent, or Firm*—Pollock, Vande Sande & Priddy

[57] ABSTRACT

A shelter structure extending above and below ground level, with a roof supported by posts and with walls, ceiling and basement floor composed of cast rigid plastic foam panels connected to said walls and posts.

6 Claims, 3 Drawing Figures

HEAVILY INSULATED SHELTER STRUCTURE

This is a continuation of application Ser. No. 971,597, filed Dec. 20, 1978, and now abandoned.

It has been found that above latitude 30° not much is to be gained from capturing and utilizing solar heat unless the shelter structure where it is to be used for internal heating is a heavily insulated building constructed primarily for this same purpose.

Figure 1:
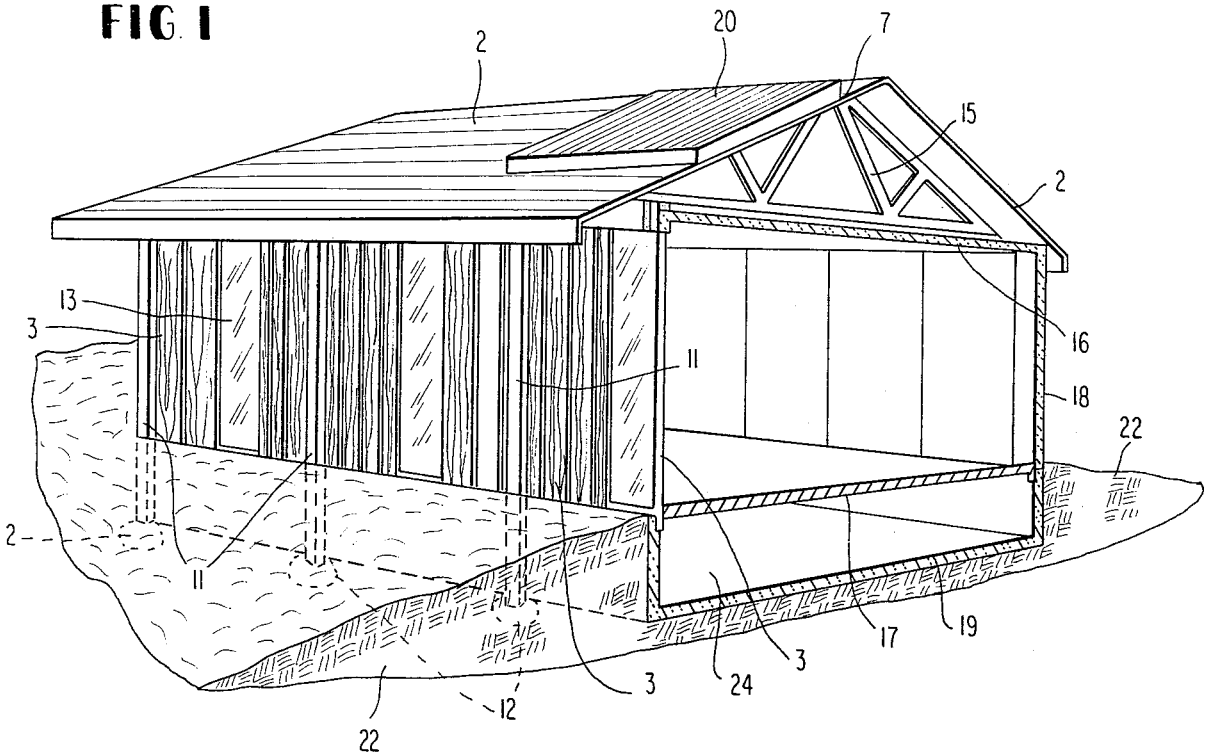
FIG. 1 is a view in prospective of my Heavily Insulated Shelter Structure.
Figure 2:
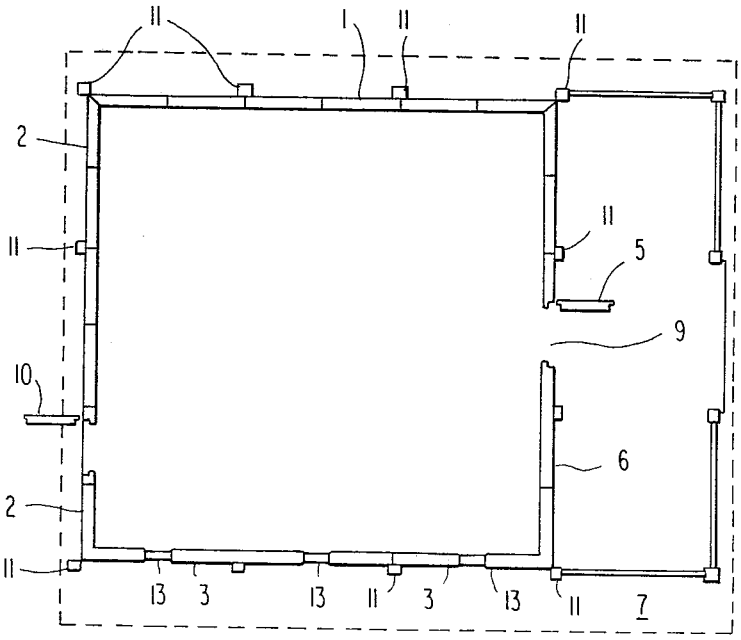
FIG. 2 is a diagrammatic plan view of the structure shown in FIG. 1.

In describing these figures of the drawing it will be noted that the ground level is always numeral 22.

Figure 3:
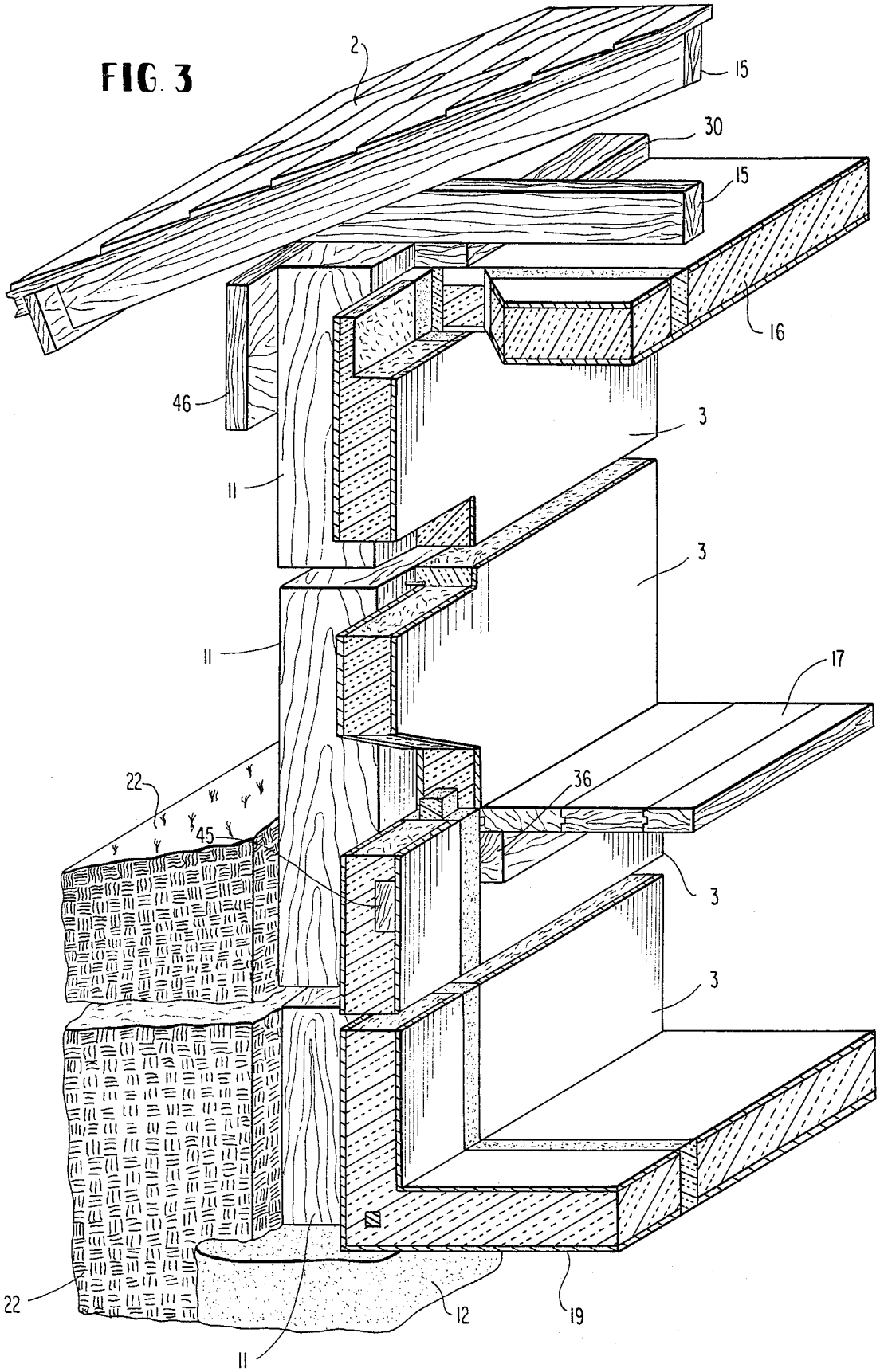
FIG. 3 is a corner view of one of my shelter structures posts shown in its several sections.

The building comprises four walls numbered 1, 2, 3, and 6, held in position by vertical posts, 11, the details of which (posts) are shown in FIG. 3. Along the upper portions of the posts is a horizontal beam 46 on which sits a series of trusses 15 holding up a peaked roof 29 and an innerfoam ceiling 16.

Each post 11 rests upon a buried footing 12. To each post is fastened side wall panels 3 or 1 or 2 or 6.

Essentially this is somewhat similar to what is known in Vermont as the pole barn, an inexpensive form a barn construction that dates back into the 1700's.

The big problem with solar energy structures up until the present has been their relatively high cost. But, this invention directly reduces the cost of shelter structures of all sizes and especially of smaller sizes that are to be used by their owners as suitable solar dwellings.

Moreover, below latitude 30°, is the summer problem of air conditioning. By using my foam lock U.S. Pat. No. 3,854,260 the air conditioning of my structure are most effective and economic.

This monolithic type building basically comprises four walls 1, 2, 3, and 6, a ceiling 16 and a basement floor 19 all held in place by wooden posts #11 and interlocked in the foam lock manner (see patent noted). Below ground these post are treated with creasote against decay.

The wooden floor 17 is fastened to the post 4 by spikes or bolts extending through cross numbers 36 and 45, the floor member is merely the customary tongue and groove material.

In like manner the ceiling 16 is held up and fastened safely to the under horizontal members of the wooden truss 15.

The space between floor 17 and the basement floor 19 is preferably utilized to contain a bank of sand or small pebbles. These are used as solar heat storage and provides the rest of the house with warmth when the sun is not shining.

Under certain circumstances the entire post is treated either with creasote or other chemical to slow or stop decay of the wood. The posts 11 can be thus produced in large quantities and all being interchangeable in the general erection (or installation) procedure.

Bolts not shown are used as fastening means whereby the ceiling panels 16 are fastened to the overhead truss number 15. Bolts also not shown anchor the under floor members 36 through to posts 11.

Lag screws can be used as well as bolts, and either of these can be made of plastic as well as metal.

I claim:

1. In a building structure of the type including a plurality of spaced post members each extending in a substantially vertical direction from an underground footing, said building structure further comprising a roof assembly including a series of trusses resting on beam members and supported on vertically upper end portions of said post members and said building structure including a floor assembly extending between said substantially vertically extending post members, wherein the improvement comprises:

insulative means for thermally insulating an interior space within said building structure to prevent transfer of heat between said interior space and a further, exterior space adjacent said building structure;

said insulative means comprising a plurality of panel-like wall members attached to one another along confronting surfaces, each of said wall members being formed of a molded polyurethane-type foam material;

said insulative means further comprising a ceiling panel assembly attached to said roof assembly and contacting vertically upper end portions of said wall members, and a basement floor assembly contacing vertically lower end portions of said wall members, with said ceiling panel assembly and said basement floor assembly each being formed of molded polyurethane-type foam material;

wherein said ceiling panel assembly and said wall members form a continuous joint of polyurethane-type form material completely surrounding said interior space to prevent heat from leaking therethrough, and wherein said floor basement assembly and said wall members form a continuous joint completely surrounding said interior space to prevent heat from leaking therethrough.

2. A building structure according to claim 1, wherein a further plurality of substantially horizontally extending beam members are positioned adjacent an inner wall surface of said wall assembly and are attached to said post members via a plurality of fasteners, with said further horizontally extending beam members contacting and providing support for said floor assembly.

3. A building structure according to claim 1, wherein said basement floor assembly comprises a plurality of separate, panel-like floor members attached to one another along confronting edge surfaces, with each of said panel-like floor members being formed of a molded polyurethane-type foam material to provide a barrier against the transfer of heat through said basement floor.

4. A building structure according to claim 1, wherein said ceiling assembly comprises a plurality of separate panel-like ceiling members attached to one another along confronting edge surfaces and further attached to said series of trusses.

5. A building structure according to claim 1, wherein said building includes at least one window assembly extending between said floor and ceiling assemblies, said window assembly having a pair of opposite edge surfaces in abuting contact with confronting edge surfaces of said panel-like wall members.

6. A building structure according to claim 1, wherein said building includes at least one door assembly pivotally attached to a portion of said wall assembly.

* * * * *